US008516667B2

(12) United States Patent
Virgen

(10) Patent No.: US 8,516,667 B2
(45) Date of Patent: Aug. 27, 2013

(54) SEAT BELT BUCKLE

(75) Inventor: Octavio Morones Virgen, Metepec (MX)

(73) Assignee: GM Global Technology Operations LLC, Detroit, MI (US)

( * ) Notice: Subject to any disclaimer, the term of this patent is extended or adjusted under 35 U.S.C. 154(b) by 670 days.

(21) Appl. No.: 12/782,739

(22) Filed: May 19, 2010

(65) Prior Publication Data

US 2011/0283493 A1 Nov. 24, 2011

(51) Int. Cl.
*A44B 11/26* (2006.01)
*A44B 11/25* (2006.01)

(52) U.S. Cl.
USPC ..... 24/641; 24/642; 24/649

(58) Field of Classification Search
USPC ..... 24/641, 642, 649
See application file for complete search history.

(56) References Cited

U.S. PATENT DOCUMENTS 3,825,979 A * 7/1974 Jakob ..... 24/579.11
4,450,604 A * 5/1984 Oowada ..... 24/641
4,899,424 A 2/1990 Barnes et al.
4,945,617 A 8/1990 Griffith
5,142,748 A * 9/1992 Anthony et al. ..... 24/642
5,213,365 A * 5/1993 Fohl ..... 24/642
5,271,129 A 12/1993 Clarke et al.
5,870,810 A 2/1999 Harrison et al.
5,915,633 A 6/1999 Biller
6,216,323 B1 4/2001 Oyamada
6,292,988 B1 9/2001 Jackson et al.
6,438,810 B2 8/2002 Rogers, Jr. et al.
6,463,639 B1 * 10/2002 Mori ..... 24/642
6,725,509 B1 4/2004 Lee et al.
2004/0205944 A1 * 10/2004 Muromachi et al. ..... 24/642

* cited by examiner

*Primary Examiner* — Robert J. Sandy
(74) *Attorney, Agent, or Firm* — Quinn Law Group, PLLC

(57) ABSTRACT

A buckle assembly includes a first plate and a second plate defining a gap therebetween. A button assembly defines a slot aligned with the gap, and is coupled to the first plate and the second plate for movement along a longitudinal axis of the first plate. The button assembly includes a door transversely moveable relative to the longitudinal axis between a closed position covering the slot and a retracted position spaced from the slot. The door includes an angled ledge, that directs fluid through at least one aperture in a sidewall of the button assembly when the door is in the closed position. A block is disposed within the gap. The first plate and the second plate define undulations extending along the longitudinal axis and into the gap. The block mates with the undulation in the first plate and the second plate to fill the gap.

18 Claims, 5 Drawing Sheets

SEAT BELT BUCKLE

TECHNICAL FIELD

The invention generally relates to a buckle assembly for a seat belt of a vehicle.

BACKGROUND

Seat belt buckle assemblies selectively attach and disconnect a latch on a seat belt to secure an occupant within a vehicle. The seat belt buckle defines a slot, through which the latch is inserted. A locking mechanism engages the latch to secure the latch relative to the buckle assembly. The buckle assembly includes a button assembly, which is depressible to release the latch from the locking mechanism, and thereby release the latch from the buckle assembly.

The slot in the buckle assembly is generally disposed in an upward facing, vertical arrangement, next to the occupant of the vehicle. When the latch is not disposed within and secured to the buckle assembly, the slot is open, and may permit debris, for example: coins, dirt, liquids (particularly sugary liquids that leave a sticky residue once dry), etc., to enter into the buckle assembly. Any debris entering the buckle assembly may become lodged within or otherwise interfere with the operation of the buckle assembly, and in particular the operation of the locking mechanism and/or the button assembly.

SUMMARY

A buckle assembly for a seat belt of a vehicle is provided. The buckle assembly includes a first plate having a first tend and extending along a longitudinal axis. A second plate having a first end is coupled to the first plate in spaced parallel relationship relative to the first plate to define a gap between the first plate and the second plate. A button assembly is coupled to the first plate and the second plate adjacent the first end of the first plate and the first end of the second plate. The button assembly defines a slot aligned with the gap between the first plate and the second plate. The button assembly is moveable relative to the first plate and the second plate along the longitudinal axis, and includes a door moveable in a direction transverse to the longitudinal axis, between a closed position and a retracted position. The door covers the slot when in the closed position, and is laterally spaced from the slot when in the retracted position.

A buckle assembly for a seat belt of a vehicle is also provided. The buckle assembly includes a first plate having a first tend and extending along a longitudinal axis. A second plate having a first end is coupled to the first plate in spaced parallel relationship relative to the first plate to define a gap between the first plate and the second plate. A button assembly is coupled to the first plate and the second plate adjacent the first end of the first plate and the first end of the second plate. The button assembly includes a ledge extending transverse to the longitudinal axis. The ledge defines a slot aligned with the gap between the first plate and the second plate. The button assembly is moveable relative to the first plate and the second plate along the longitudinal axis, and includes a door supported by the ledge and moveable in a direction transverse to the longitudinal axis between a closed position and a retracted position. The door covers the slot when in the closed position, and the door is laterally spaced from the slot when in the retracted position. The door includes an angled edge extending over the slot when the door is in the closed position. The button assembly includes at least one aperture extending through a wall of the button assembly adjacent the ledge. The angled edge of the door is configured for directing a liquid through the at least one aperture when in the closed position.

In another aspect, a buckle assembly for a seat belt of a vehicle is provided. The buckle assembly includes a first plate having a first end and extending along a longitudinal axis. A second plate having a first end is coupled to the first plate in spaced parallel relationship relative to the first plate to define a gap between the first plate and the second plate. A block is disposed within the gap between the first plate and the second plate. The block is moveable along the longitudinal axis between a raised position and a lowered position. A button assembly is coupled to the first plate and the second plate adjacent the first end of the first plate and the first end of the second plate. The button assembly is moveable relative to the first plate and the second plate along the longitudinal axis. The block includes a first vertical edge, with the upper vertical edge of the block axially aligned along the longitudinal axis with the upper end of the first plate and the upper end of the second plate when the block is in the raised position, such that the upper end of the first plate and the upper end of the second plate are flush with the upper vertical edge of the block when the block is in the raised position. Each of the first plate and the second plate includes a plurality of undulations extending along the longitudinal axis and into the gap between the first plate and the second plate. The block includes a first side surface configured to correspond and mate with the first plate, and a second side surface configured to correspond and mate with the second plate. As such, a cross section of the block perpendicular to the longitudinal axis substantially fills the gap between the first plate and the second plate.

Accordingly, the buckle assembly prevents debris, including but not limited to, coins and liquids, from entering the into the buckle assembly through the slot to maintain proper functioning of the buckle assembly. The door slides across the slot to cover the slot when the buckle assembly is not attached to a latch of a seat belt. The door blocks objects from entering the slot. The door includes an angled edge that directs fluid spilled onto the buckle assembly through the apertures in the side wall of the button assembly, which directs the fluid away from the buckle assembly. The upper vertical edge of the block is flush with the upper end of the first plate and the upper end of the second plate to enable any objects that do make it through the slot to be easily retrieved by hand. The undulations in the first plate and the second plate, and the corresponding cross sectional shape of the block, ensure that small coins may not become lodged between the block and one of the first plate and the second plate. Accordingly, all of the above described features of the buckle assembly ensure that debris does not infiltrate the buckle assembly, thereby maintaining proper functioning of the buckle assembly.

The above features and advantages and other features and advantages of the present invention are readily apparent from the following detailed description of the best modes for carrying out the invention when taken in connection with the accompanying drawings.

DETAILED DESCRIPTION

Figure 1:
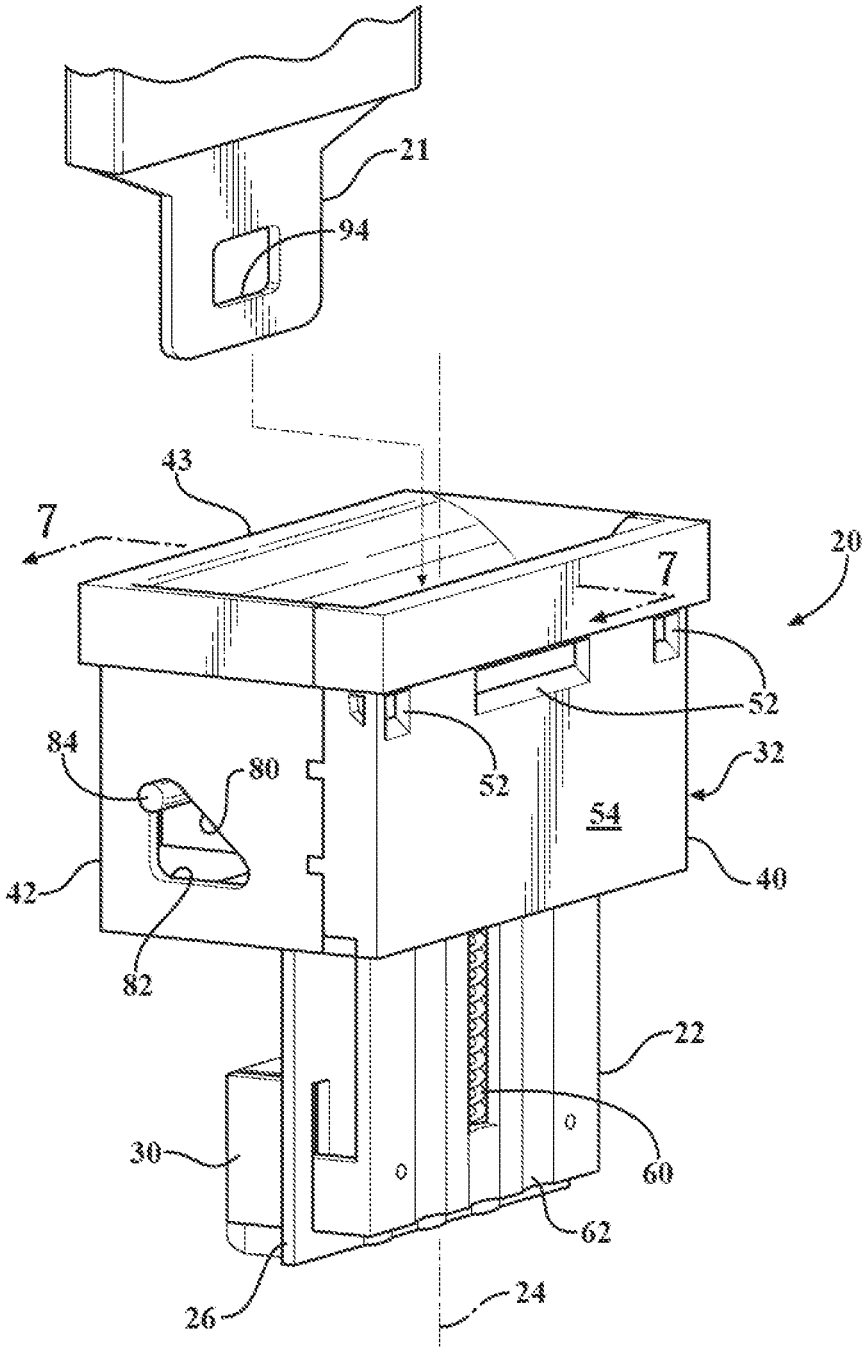
FIG. 1 is a schematic perspective view of a buckle assembly.

Referring to the Figures, wherein like numerals indicate like parts throughout the several views, a buckle assembly is shown generally at 20. The buckle assembly 20 is for a seat belt (not shown) of a vehicle. The buckle assembly 20 receives a latch plate 21, which is attached to the seat belt. The buckle assembly 20 releasably secures the latch plate 21 to the buckle assembly 20 to restrain an occupant of the vehicle.

Referring to FIGS. 1 through 3 and 7, the buckle assembly 20 includes a first plate 22. The first plate 22 extends along a longitudinal axis 24 of the buckle assembly 20. The buckle assembly 20 further includes a second plate 26. The second plate 26 is coupled to the first plate 22. The second plate 26 is arranged in spaced parallel relationship relative to the first plate 22 to define a gap 28, shown in FIG. 4, between the first plate 22 and the second plate 26. The first plate 22 and the second plate 26 may be coupled together in any suitable manner, including but not limited to, fasteners, interlocking slots and tabs, snap fit connections, etc.

Referring to FIGS. 1, 3 and 5-7, the buckle assembly 20 may further include a base 30. The base 30 is coupled to and is configured for supporting the first plate 22 and the second plate 26. The base 30 maintains the relative position of the first plate 22 and the second plate 26, with the appropriate gap 28 therebetween. The base 30 may be configured to include any size and/or shape suitable for the specific vehicle design parameters, and may include fasteners, interlocking slots and tabs, or some other device capable of securing the relative positions of the first plate 22 and the second plate 26.

Referring to FIGS. 1, 2-3 and 7, the buckle assembly 20 further includes a button assembly 32. The button assembly 32 is coupled to the first plate 22 and the second plate 26, adjacent a first end of the first plate 22, hereinafter referred to as the upper end 34 of the first plate 22, and a first end of the second plate 26, hereinafter referred to as the upper end 36 of the second plate 26. The upper end 34 of the first plate 22 and the upper end 36 of the second plate 26 may generally be defined as the vertically upper edge of the first plate 22 and the second plate 26 respectively. The button assembly 32 is moveable relative to the first plate 22 and the second plate 26 along the longitudinal axis 24. As such, the button assembly 32 may be manually pushed vertically downward from a neutral position into a depressed position, over the first plate 22 and the second plate 26 respectively. Upon release, the button assembly 32 automatically returns to the neutral position.

Figure 2:
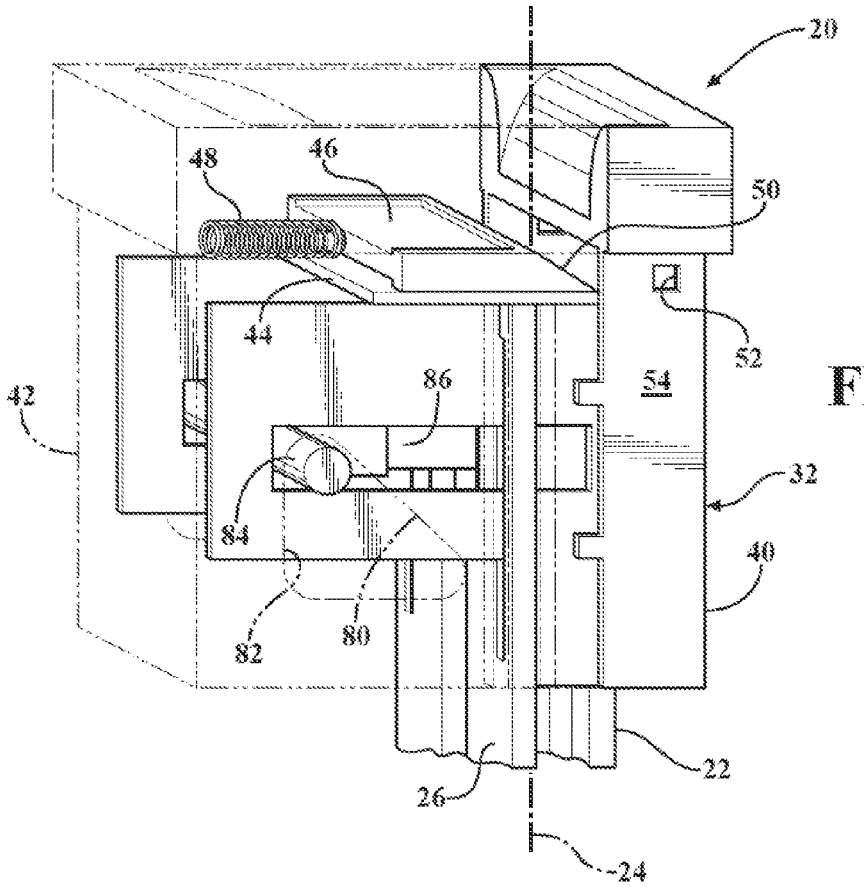
FIG. 2 is a schematic partial perspective view of the buckle assembly.
Figure 3:
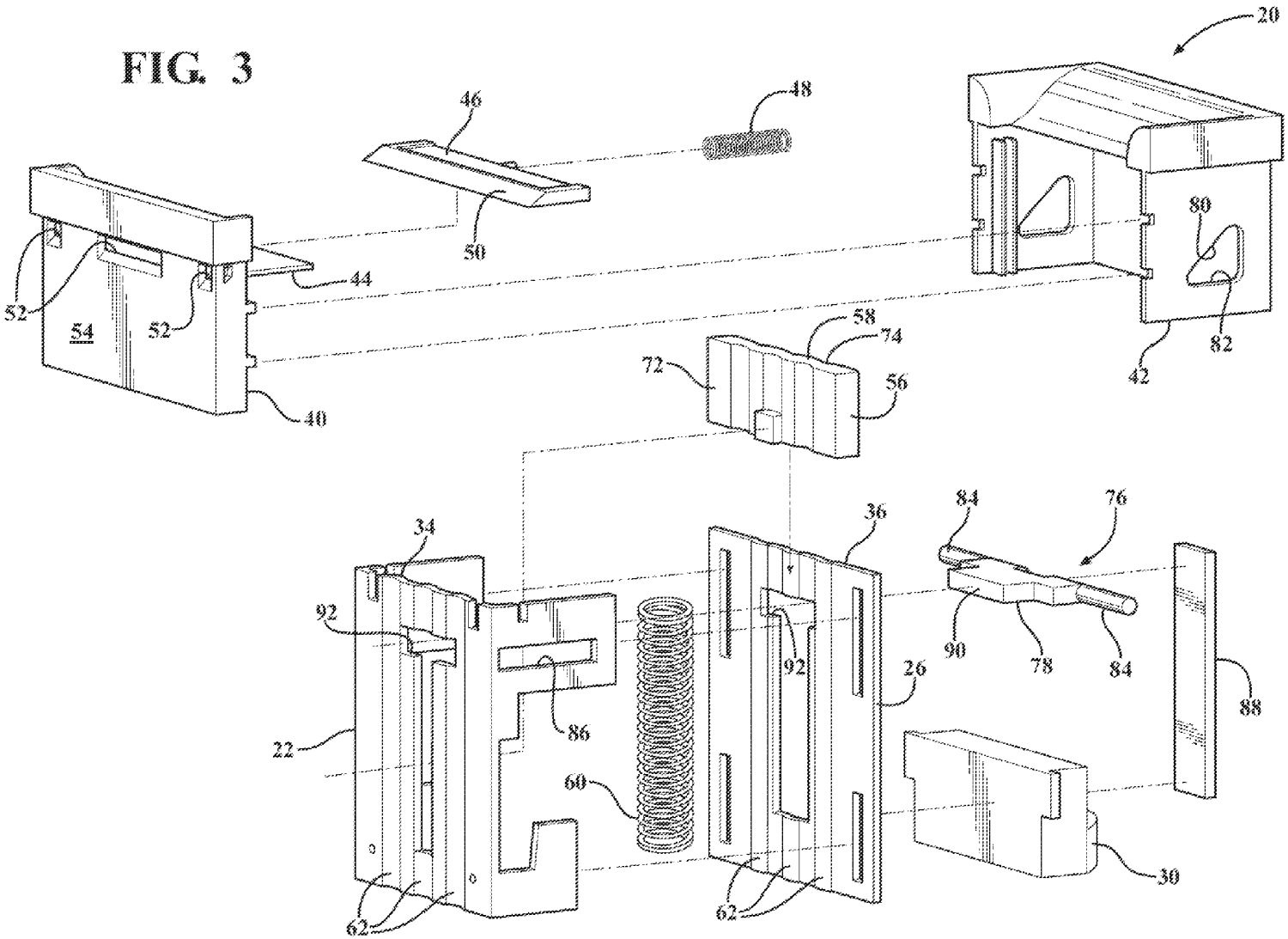
FIG. 3 is a schematic exploded perspective view of the buckle assembly.
Figure 7:
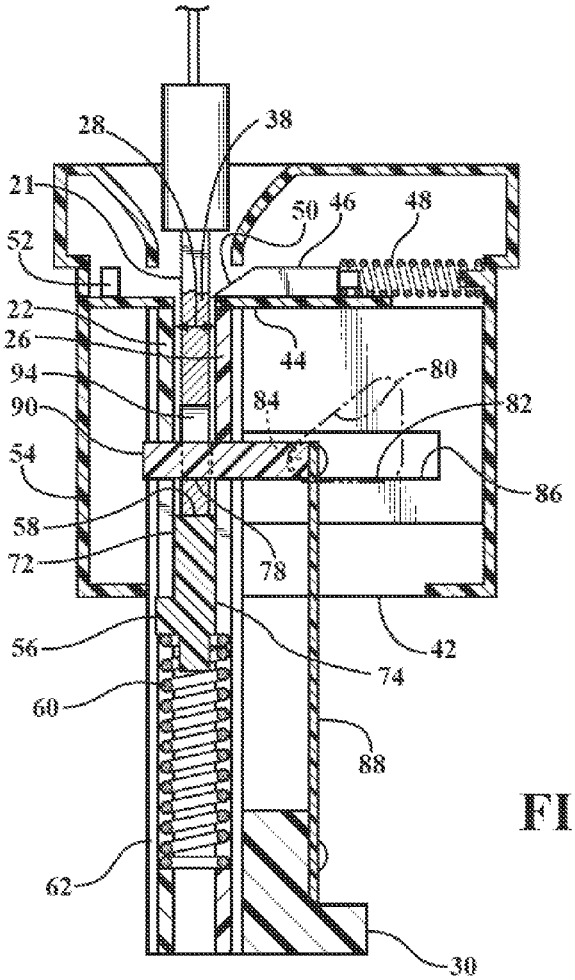
FIG. 7 is a schematic cross sectional view of the buckle assembly along cut line 7-7 shown in FIGS. 1 and 6.

The button assembly 32 defines a slot 38, shown in FIG. 7, which is aligned with the gap 28 between the first plate 22 and the second plate 26. More specifically, the button assembly 32 includes a first half 40 and a second half 42. The first half 40 is attached to the second half 42 to define a casing 43. The first half 40 and the second half 42 are generally split along a plane extending along the longitudinal axis 24. The first half 40 and the second half 42 may be attached together in any suitable manner, including but not limited to, a plurality of fasteners or a snap fit connection. Referring to FIGS. 2-3 and 7, at least one of the first half 40 and the second half 42 defines a ledge 44, which extends transverse to the longitudinal axis 24. The ledge 44 defines the slot 38. The slot 38 is oriented in a direction to allow passage of an object, e.g., the latch plate 21 of the seat belt, along a path parallel with the longitudinal axis 24, and into the gap 28 between the first plate 22 and the second plate 26.

Referring to FIGS. 2-3 and 5-7, the button assembly 32 includes a door 46. As shown, the ledge 44 supports the door 46, with the door 46 sliding over a vertically upper surface of the ledge 44. The door 46 is moveable in a direction transverse to the longitudinal axis 24. The door 46 moves between a closed position, shown in FIG. 5, and a retracted position, shown in FIG. 6. When in the closed position, the door 46 covers the slot 38. Accordingly, the door 46 blocks debris, including but not limited to coins, paperclips, etc., from entering into the gap 28 through the slot 38. When in the retracted position, the door 46 is laterally spaced from the slot 38, thereby allowing an object, such as the latch plate 21 of the seat belt, to be inserted through the slot 38 and into the gap 28.

Referring to FIGS. 2 and 3, the button assembly 32 further includes a door biasing device 48. The door biasing device 48 is configured to bias the door 46 into the closed position. As shown, the door biasing device 48 includes a coil spring disposed transverse relative to the longitudinal axis 24, between the door 46 and a side wall of the casing 43. The door 46 and/or the casing 43 may include various structural features for aligning the door biasing device 48 and securing the relative position of the door biasing device 48. It should be appreciated, that the door biasing device 48 may include some other device not shown or described herein that is capable of biasing the door 46 into the closed position.

Referring to FIGS. 2, 3 and 5-7, the door 46 includes an angled edge 50. The angled edge 50 extends over the slot 38 when the door 46 is in the closed position. The angled edge 50 is configured for re-directing a force applied onto the angled edge 50 along the longitudinal axis 24 by an object to a direction transverse to the longitudinal axis 24 to move the door 46 into the retracted position. As such, when the latch plate 21 is inserted into the button assembly 32, the latch plate 21 contacts the angled edge 50 of the door 46. Application of force to the latch plate 21 imparts a force onto the angled edge 50 of the door 46. The angled edge 50 of the door 46 breaks the force into a vertical component directed along the longitudinal axis 24, and a horizontal or lateral component directed transverse to the longitudinal axis 24. The lateral component of the force acts on the door 46 to move the door 46 into the refracted position, to thereby allow passage of the latch plate 21 through the slot 38 and into the gap 28. Upon removal of the latch plate 21, the door biasing device 48 moves the door 46 back into the closed position to close the slot 38.

Figure 5:
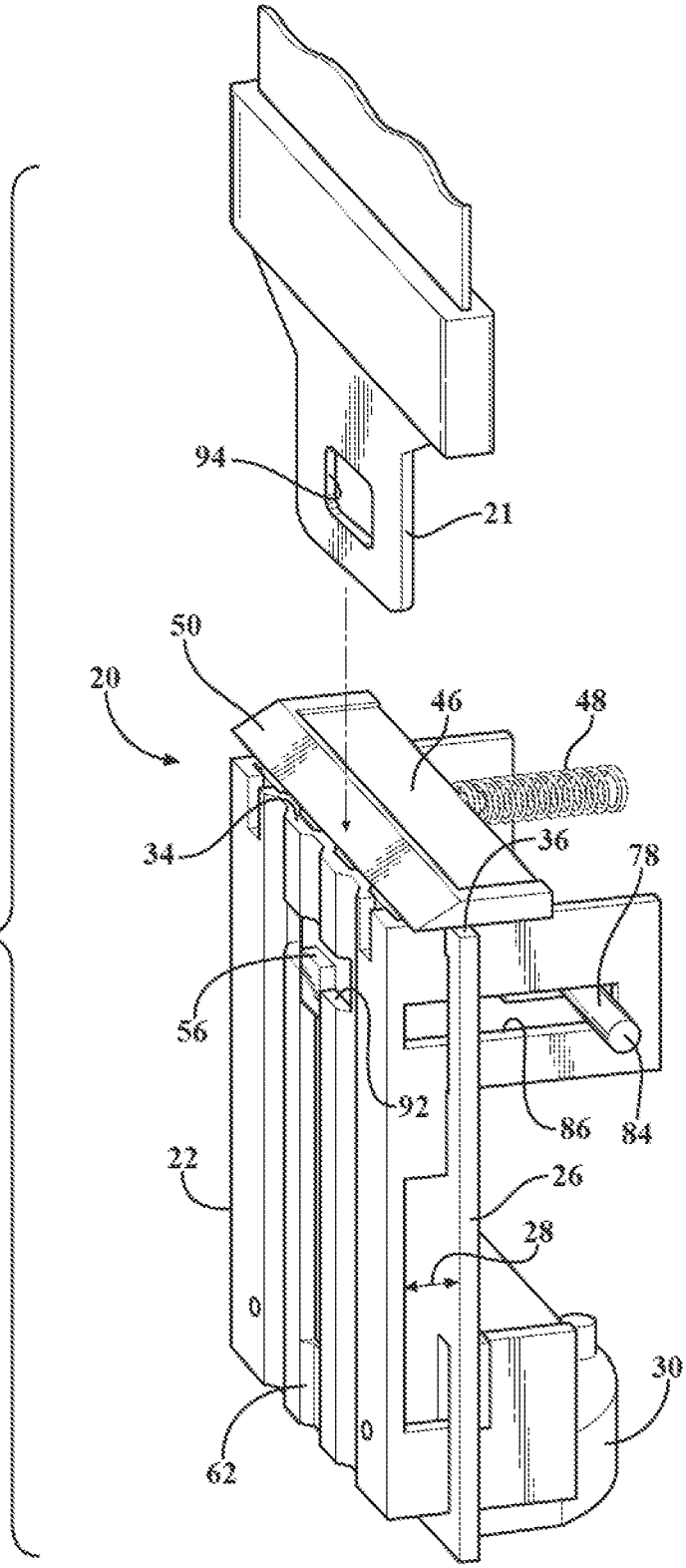
FIG. 5 is a schematic partial perspective view of the buckle assembly showing a door in a closed position.

Referring to FIGS. 1-3 and 7, the button assembly 32 includes at least one aperture 52 extending through a side wall 54 of the casing 43. More specifically, at least one of the first half 40 and the second half 42 of the button assembly 32 include at least one aperture 52 extending through a side wall 54 of the button assembly 32 adjacent the ledge 44. The side wall 54 of the button assembly 32 may generally be defined as a vertically extending wall of the casing 43. As best shown in FIG. 5, the aperture 52 is generally disposed at a level or height equal to or lower than the ledge 44. As such, the aperture 52 and the ledge 44 may be axially aligned along the longitudinal axis 24, or the aperture 52 may be vertically offset below the ledge 44. The angled edge 50 of the door 46 is configured for directing a liquid through the aperture 52 when in the closed position. More specifically, the angled edge 50 of the door 46 is orientated to direct fluid vertically downward and away from the slot 38. Accordingly, because the aperture 52 is disposed at or below the ledge 44, with the door 46 disposed vertically over the ledge 44, the angled edge 50 of the door 46 directs fluid to the aperture 52, and allows gravity flow to drain the fluid out of and away from the buckle assembly 20 through the aperture 52. Draining fluids out of and away from the buckle assembly 20 prevents residue buildup within the buckle assembly 20, which may negatively affect performance of the buckle assembly 20. The aperture 52 may include any suitable size, shape, configuration and/or number of apertures 52 suitable for the particular design of the vehicle.

Figure 6:
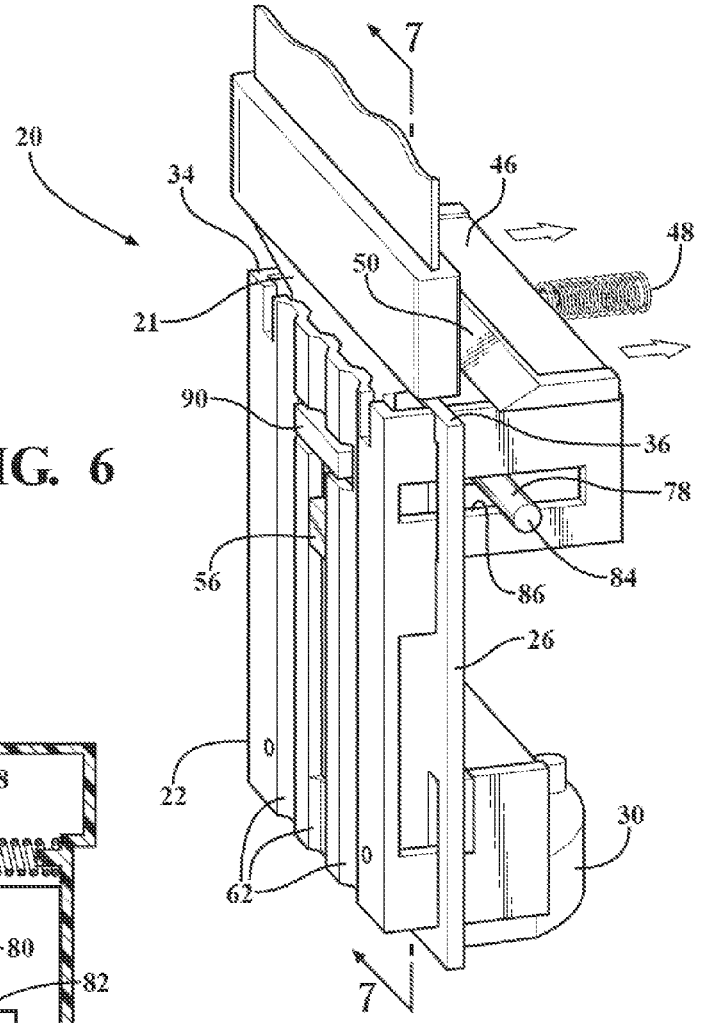
FIG. 6 is a schematic partial perspective view of the buckle assembly showing the door in a refracted position.

Referring to FIGS. 3 and 7, the buckle assembly 20 further includes a block 56. The block 56 is disposed within the gap 28, between the first plate 22 and the second plate 26. The block 56 is moveable along the longitudinal axis 24, between a raised position and a lowered position. As best shown in FIG. 6, the block 56 includes a first edge, hereinafter referred to as the upper vertical edge 58 of the block 56, which is axially aligned along the longitudinal axis 24 with the upper end 34 of the first plate 22 and the upper end 36 of the second plate 26 when the block 56 is in the raised position. As such, the upper end 34 of the first plate 22 and the upper end 36 of the second plate 26 are flush with the upper vertical edge 58 of the block 56 when the block 56 is in the raised position. The block 56 is disposed in the raised position when the buckle assembly 20 is disconnected from the latch plate 21. The block 56 is configured for movement into the lowered position in response to a force applied along the longitudinal axis 24 to the block 56 by an object inserted through the slot 38, e.g., the latch plate 21 of the seat belt. Upon insertion of the latch plate 21 into the gap 28, the latch plate 21 displaces the block 56 vertically downward, into the lowered position.

Referring to FIGS. 3 and 7, the buckle assembly 20 further includes a block biasing device 60. The block biasing device 60 is configured for biasing the block 56 into the raised position. As shown, the block biasing device 60 includes a coil spring supported by the first plate 22 and the second plate 26 and biasing against the block 56 in a generally vertical upward direction parallel with the longitudinal axis 24. However, it should be appreciated that the block biasing device 60 may include some other device not shown or described herein capable of biasing the block 56 into the raised position.

Figure 4:
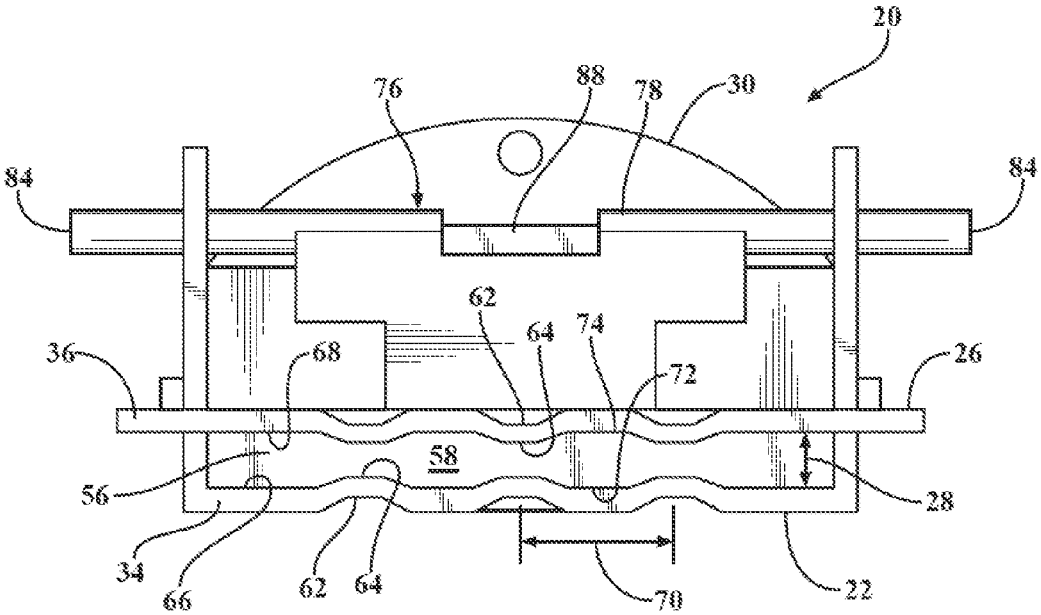
FIG. 4 is a schematic partial top cross sectional view of the buckle assembly.

Referring also to FIG. 4, each of the first plate 22 and the second plate 26 include at least one undulation 62. As shown, each of the first plate 22 and the second plate 26 include a plurality of undulations 62. The undulations 62 extend along the longitudinal axis 24, and also extend into the gap 28 between the first plate 22 and the second plate 26. As shown, each of the first plate 22 and the second plate 26 include three undulations 62. However, it should be appreciated that the first plate 22 and the second plate 26 may include any number of undulations 62 needed to meet any specific design requirements. As shown, the undulations 62 include a generally arcuate, concave shape extending into the gap 28. However, it should be appreciated that the undulations 62 may include some other shape, including but not limited to a triangular shape for example, not shown or described herein.

Each of the undulations 62 in the first plate 22 and the second plate 26 include a peak 64. The peak 64 is laterally spaced from a planar surface 66 of the first plate 22 and a planar surface 68 of the second plate 26 respectively. In other words, the peaks 64 of the undulations 62 on the first plate 22 are laterally spaced from the planar surface 66 of the first plate 22, and the peaks 64 of the undulations 62 on the second plate 26 are laterally spaced from the planar surface 68 of the second plate 26. Adjacent peaks 64 of the plurality of undulations 62 on the first plate 22 may be spaced in parallel relationship with each other an offset distance 70 less than or equal to 15 mm apart. Adjacent peaks 64 of the plurality of undulations 62 on the second plate 26 may be spaced in parallel relationship with each other an offset distance 70 less than or equal to 15 mm apart. Having the peaks 64 on each of the first plate 22 and the second plate 26 spaced from adjacent peaks 64 a distance of 15 mm apart or less ensures that even small coins, such as a penny and/or a dime, can not fit between the undulations 62. It should be appreciated the offset distance 70 may vary from that specifically described herein.

As shown, each of the plurality of undulations 62 on the first plate 22 is disposed opposite one of the plurality of undulations 62 on the second plate 26. However, it should be appreciated that the undulations 62 need not be disposed directly across from each other, and may alternatively be arranged in a staggered formation.

The block 56 includes a first side surface 72 that is configured to correspond to and mate with the first plate 22. The block 56 further includes a second side surface 74 that is configured to correspond to and mate with the second plate 26. Accordingly, a cross section of the block 56 perpendicular to the longitudinal axis 24 substantially fills the gap 28 between the first plate 22 and the second plate 26. Because the block 56 substantially fills the gap 28 between the first plate 22 and the second plate 26, any objects falling through the slot 38 are prevented from passing the block 56. Additionally, the undulations 62 in the first plate 22 and the second plate 26, and the corresponding shape of the block 56, ensure that objects of a certain length are spaced away from the first plate 22 and/or the second plate 26 to prevent the objects from becoming lodged between the block 56 and the first plate 22 or the second plate 26. This is because objects of sufficient length, i.e., 15 mm apart or greater, are forced into contact with one or more of the undulations 62, thereby spacing the object from the planar surface 66 of the first plate 22 or the planar surface 68 of the second plate 26.

Referring back to FIGS. 3 and 5, the buckle assembly 20 further includes a locking mechanism 76. As shown, the locking mechanism 76 may include a lock bar 78 that is coupled to the second plate 26. The lock bar 78 is moveable between an unlocked position and a locked position. The lock bar 78 moves in a transverse direction relative to the longitudinal axis 24 in response to movement of the button assembly 32 along the longitudinal axis 24.

The button assembly 32 includes a cam 80 engaging the lock bar 78. As shown, the cam 80 includes a triangular cutout 82 in opposing walls of the casing 43. The lock bar 78 includes a pair of posts 84 extending in opposite directions through and engaging the triangular cutouts 82. Additionally, the posts 84 of the lock bar 78 are disposed in transverse slots 86 defined by the first plate 22. Accordingly, the lock bar 78 may only move toward or away from the first plate 22, in a transverse direction relative to the longitudinal axis 24. Vertical movement of the button assembly 32 causes the posts 84 of the lock bar 78 to engage the hypotenuse of the triangular cutouts 82, such that the cam 80 moves the lock bar 78 laterally relative to the longitudinal axis 24, i.e., away from the first plate 22 and into the unlocked position in response to downward movement of the button assembly 32 along the longitudinal axis 24.

The buckle assembly 20 further includes a lock biasing device 88. The lock biasing device 88 interconnects the lock bar 78 and the base 30. The lock biasing device 88 is configured for biasing the lock bar 78 into the locked position, i.e., toward the first plate 22. As shown, the lock biasing device 88 includes a spring bar extending between and interconnecting the base 30 and the lock bar 78. However, it should be appreciated that the lock biasing device 88 may include some other device not shown or described herein capable of biasing the lock bar 78 toward the first plate 22, into the locked position.

The lock bar 78 includes a tab 90. The tab 90 extends from the lock bar 78 towards the first plate 22 and the second plate 26. The tab 90 is laterally spaced from the first plate 22 when the lock bar 78 is in the unlocked position. The tab 90 extends through a lock slot 92 in each of the first plate 22 and the second plate 26 when the lock bar 78 is in the locked position.

During use, the latch plate 21 is inserted through the slot 38 and engages the block 56. The block 56, when in the raised position, prevents the tab 90 on the lock bar 78 from extending through the lock slot 92 in the first plate 22. As the latch plate 21 is pushed downward into the gap 28, the block 56 is pushed downward until no longer engaging the tab 90 on the lock bar 78. Once the tab 90 on the lock bar 78 is no longer blocked by the block 56, the tab 90 is free to move into the locked position, wherein the tab 90 passes through a passage 94 in the latch plate 21 and into interlocking engagement with the latch plate 21 and the lock slot 92 in the first plate 22. Upon pushing the button assembly 32 downward, the cam 80 moves the lock bar 78 into the unlocked position, thereby releasing the interlocking engagement between the tab 90 and the latch plate 21, allowing withdrawal of the latch plate 21. It should be appreciated that the locking mechanism 76 may include any mechanism capable of unlocking the latch plate 21 from the buckle assembly 20, and may be configured and operate other than showed and described herein.

While the best modes for carrying out the invention have been described in detail, those familiar with the art to which this invention relates will recognize various alternative designs and embodiments for practicing the invention within the scope of the appended claims.

The invention claimed is:

1. A buckle assembly for a seat belt of a vehicle, the buckle assembly comprising:

a first plate having a first end and extending along a longitudinal axis;

a second plate having a first end and coupled to the first plate in spaced parallel relationship relative to the first plate to define a gap between the first plate and the second plate; and a button assembly coupled to the first plate and the second plate adjacent the first end of the first plate and the first end of the second plate, and defining a slot aligned with the gap between the first plate and the second plate, wherein the button assembly is moveable relative to the first plate and the second plate along the longitudinal axis;

wherein the button assembly includes a door moveable in a direction transverse to the longitudinal axis between a closed position and a retracted position, wherein the door covers the slot when in the closed position, and is laterally spaced from the slot when in the retracted position;

wherein the button assembly includes a first half and a second half attached to the first half;

wherein at least one of the first half and the second half define a ledge extending transverse to the longitudinal axis; and wherein the ledge defines the slot and supports the door.

2. A buckle assembly as set forth in claim 1 wherein the button assembly further includes a door biasing device configured to bias the door into the closed position.

3. A buckle assembly as set forth in claim 2 wherein the door includes an angled edge extending over the slot when the door is in the closed position, wherein the angled edge is configured for re-directing a force applied onto the angled edge along the longitudinal axis by an object to a direction transverse to the longitudinal axis to move the door into the retracted position.

4. A buckle assembly as set forth in claim 3 wherein at least one of the first half and the second half include at least one aperture extending through a wall of the button assembly adjacent the ledge, wherein the angled edge of the door is configured for directing a liquid through the at least one aperture when in the closed position.

5. A buckle assembly as set forth in claim 1 further comprising a block disposed within the gap between the first plate and the second plate and moveable along the longitudinal axis between a raised position and a lowered position.

6. A buckle assembly as set forth in claim 5 wherein the block includes an first vertical edge axially aligned along the longitudinal axis with the upper end of the first plate and the upper end of the second plate when the block is in the raised position, such that the upper end of the first plate and the upper end of the second plate are flush with the upper vertical edge of the block when the block is in the raised position.

7. A buckle assembly as set forth in claim 6 further comprising a block biasing device configured for biasing the block into the raised position, wherein the block is configured for movement into the lowered position in response to a force applied along the longitudinal axis to the block by an object inserted through the slot.

8. A buckle assembly as set forth in claim 5 wherein each of the first plate and the second plate include at least one undulation extending along the longitudinal axis and into the gap between the first plate and the second plate.

9. A buckle assembly as set forth in claim 8 wherein the at least one undulation includes a peak laterally spaced from a planar surface of the first plate and a planar surface of the second plate respectively.

10. A buckle assembly as set forth in claim 9 wherein the at least one undulation includes a plurality of undulations, wherein adjacent peaks of the plurality of undulations on the first plate are spaced in parallel relationship with each other a distance less than or equal to 15 mm apart, and wherein adjacent peaks of the plurality of undulations on the second plate are spaced in parallel relationship with each other a distance less than or equal to 15 mm apart.

11. A buckle assembly as set forth in claim 10 wherein the block includes a first side surface configured to correspond and mate with the first plate, and a second side surface configured to correspond and mate with the second plate, such that a cross section of the block perpendicular to the longitudinal axis substantially fills the gap between the first plate and the second plate.

12. A buckle assembly as set forth in claim 11 wherein each of the plurality of undulations on the first plate is disposed opposite one of the plurality of undulations on the second plate.

13. A buckle assembly as set forth in claim 1 further comprising a base coupled to and configured for supporting the first plate and the second plate.

14. A buckle assembly as set forth in claim 13 further comprising a locking mechanism including a lock bar coupled to the second plate and moveable between an unlocked position and a locked position in a transverse direction relative to the longitudinal axis in response to movement of the button assembly along the longitudinal axis, wherein the lock bar includes a tab that is laterally spaced from the first plate when the lock bar is in the unlocked position, and extends through a lock slot in each of the first plate and the second plate when the lock bar is in the locked position.

15. A buckle assembly as set forth in claim 14 further comprising a lock biasing device interconnecting the lock bar and the base, and configured for biasing the lock bar into the locked position.

16. A buckle assembly as set forth in claim 15 wherein the button assembly includes a cam engaging the lock bar, wherein the cam moves the lock bar laterally relative to the longitudinal axis into the unlocked position in response to downward movement of the button assembly along the longitudinal axis.

17. A buckle assembly for a seat belt of a vehicle, the buckle assembly comprising:

a first plate having a first end and extending along a longitudinal axis;

a second plate having a first end and coupled to the first plate in spaced parallel relationship relative to the first plate to define a gap between the first plate and the second plate; and a button assembly coupled to the first plate and the second plate adjacent the first end of the first plate and the first end of the second plate, and including a ledge extending transverse to the longitudinal axis and defining a slot aligned with the gap between the first plate and the second plate, wherein the button assembly is moveable relative to the first plate and the second plate along the longitudinal axis;

wherein the button assembly includes a door supported by the ledge and moveable in a direction transverse to the longitudinal axis between a closed position and a retracted position, with the door covering the slot when in the closed position, and the door laterally spaced from the slot when in the retracted position;

wherein the door includes an angled edge extending over the slot when the door is in the closed position; and wherein the button assembly includes at least one aperture extending through a wall of the button assembly adjacent the ledge, with the angled edge of the door configured for directing a liquid through the at least one aperture when in the closed position.

18. A buckle assembly for a seat belt of a vehicle, the buckle assembly comprising:

a first plate having a first end and extending along a longitudinal axis;

a second plate having a first end and coupled to the first plate in spaced parallel relationship relative to the first plate to define a gap between the first plate and the second plate;

a block disposed within the gap between the first plate and the second plate and moveable along the longitudinal axis between a raised position and a lowered position;

a button assembly coupled to the first plate and the second plate adjacent the first end of the first plate and the first end of the second plate, wherein the button assembly is moveable relative to the first plate and the second plate along the longitudinal axis;

wherein the block includes a first vertical edge, with the upper vertical edge of the block axially aligned along the longitudinal axis with the upper end of the first plate and the upper end of the second plate when the block is in the raised position, such that the upper end of the first plate and the upper end of the second plate are flush with the upper vertical edge of the block when the block is in the raised position;

wherein each of the first plate and the second plate include a plurality of undulations extending along the longitudinal axis and into the gap between the first plate and the second plate; and wherein the block includes a first side surface configured to correspond and mate with the first plate, and a second side surface configured to correspond and mate with the second plate, such that a cross section of the block perpendicular to the longitudinal axis substantially fills the gap between the first plate and the second plate.

* * * * *